US007275969B2

(12) United States Patent
Fukaya et al.

(10) Patent No.: US 7,275,969 B2
(45) Date of Patent: Oct. 2, 2007

(54) TERMINAL FITTING

(75) Inventors: Tomoyoshi Fukaya, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/481,230

(22) Filed: Jul. 5, 2006

(65) Prior Publication Data

US 2007/0010140 A1 Jan. 11, 2007

(30) Foreign Application Priority Data

Jul. 5, 2005 (JP) ..... 2005-196414

(51) Int. Cl.
*H01R 11/22* (2006.01)

(52) U.S. Cl. ..... 439/851

(58) Field of Classification Search ..... 439/852, 439/851, 850

See application file for complete search history.

(56) References Cited

U.S. PATENT DOCUMENTS 5,158,485 A * 10/1992 Saito et al. ..... 439/843
5,562,501 A * 10/1996 Kinoshita et al. ..... 439/852
5,735,717 A * 4/1998 Nabeshima ..... 439/851
6,089,928 A 7/2000 Miwa et al.
6,126,495 A 10/2000 Lolic et al.
6,679,738 B2 * 1/2004 Nimura ..... 439/852
2005/0101198 A1 * 5/2005 Maeda ..... 439/852
2005/0153605 A1 * 7/2005 Anbo et al. ..... 439/852

FOREIGN PATENT DOCUMENTS

JP 2000-200667 7/2000
JP 2000-231956 8/2000
WO WO95/28020 10/1995

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

A terminal fitting (10) has a rectangular tube (13) with opposed first and second side plates (15, 16). A upper plate (17) is bent from the first side plate (15) into contact with the second side plate (16). A standing portion (23) stands up from the second side plate (16) and a pressing portion (25) is bent from the standing portion (23) and placed on the outer surface of the upper plate (17) to prevent the upper plate (17) from lifting. The pressing portion (25) is formed within a projecting range of the standing portion (23) to improve a yield of a punching operation from a metal plate.

12 Claims, 8 Drawing Sheets

TERMINAL FITTING

BACKGROUND OF THE INVENTION

1. Field of the Invention

The invention relates to a terminal fitting and to a method of forming it.

2. Description of the Related Art

Japanese Unexamined Patent Publication No. 2000-200667 discloses a terminal fitting with a rectangular tube that has opposed first and second side plates and a top plate that is bent from an upper end of the first side plate. A groove is formed in the second side plate, and a projection of the top plate fits into the groove. Tight engagement of the projection in the groove prevents the top plate form lifting due to its resilient restoring movement.

The rectangular tube could be twisted during formation of the terminal fitting, and such twisting would require the position of the top plate to be corrected with respect to forward and backward directions and vertically so that the projection can fit in the groove. To address this problem, consideration has been given to forming the side plate with an extension that extends up farther than the connection of the top plate and the second side plate. The extension is bent into a U-shape and contacts the top plate from above to prevent the top plate from lifting.

The terminal fitting is cut and formed from a metal blank that is designed to achieve efficient use of the metal. The above-described extension must be sufficiently long to be bent into contact with the top plate. As a result, a projecting distance of the extension on the metal blank is long and leads to a reduced a yield of terminal fittings from the metal blank.

The invention was developed in view of the above, and an object thereof is to provide a terminal fitting that prevents a ceiling plate from lifting and improving a yield in a punching an electrically conductive blank.

SUMMARY OF THE INVENTION

The invention is a terminal fitting with a tube that has first and second side plates and a ceiling plate bent from a top end of the first side plate towards the second side plate. The second side plate has at least one standing portion that stands more outward than a connected portion of the second side plate with the ceiling plate. At least one pressing portion is bent inward from an intermediate height of the standing portion and is placed on the outer surface of the ceiling plate. Placement of the pressing portion on the outer surface of the ceiling plate prevent an opening deformation of the ceiling plate and corrects the posture of the ceiling plate even if the tube is twisted.

The pressing portion is formed in a projecting range of the standing portion and is bent in from an intermediate height position of the standing portion. Thus, projecting distances of the standing portion and the pressing portion on the metal blank are shorter than when an extension extends up or out from the side plate and then is folded back into contact with the ceiling plate. Therefore, a yield of the terminal fittings can be improved.

A detecting portion preferably is formed by bending the upper end of the standing portion inwardly and can be contacted by a probe for testing an electrical connection of the terminal fitting. The probe for an electrical connection test can be brought easily into contact with an area where the standing portion is bent. Therefore the precision of the electrical connection test for the terminal fitting can be improved.

At least one lift preventing portion preferably is formed at least at a front part or at a rear part of the standing portion to prevent the ceiling plate from lifting. Accordingly, an opening movement of the ceiling plate can be prevented even in an area where the standing portion is not provided.

At least one of the lift preventing portions is formed with at least one recess at or near the upper edge of the second side plate. At least one projecting piece is provided at or near an end edge of the ceiling plate and can fit into the recess. The projecting piece is crimped, bent, folded or deformed into connection with side walls of the recess. Accordingly, a member provided above the upper plate to preventing a lift of the upper plate can be omitted at least in the area of the lift preventing portion. Therefore, a yield of the terminal fittings can be improved.

A leading edge of the standing portion preferably is recessed for preventing interference with the pressing portion.

A chamfered or rounded surface preferably is formed at the lateral edge of the leading end of the pressing portion near the ceiling plate and/or a chamfered or rounded surface is formed at the lateral edge of the leading end of the ceiling plate that contacts the pressing portion to avoid interference of the pressing portion and the ceiling plate upon assembling the tube.

A resilient contact preferably is provided in the tube for contacting a mating terminal fitting. At least one auxiliary resilient piece preferably is provided and engages the resilient contact when the mating terminal fitting is inserted into the tube. Thus, the auxiliary resilient piece improves the rigidity of the resilient contact.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female terminal fitting 10 according to a first embodiment of the invention is described with reference to FIGS. 1 to 7, and is formed unitarily by punching, pressing, stamping, embossing, folding and/or bending an electrically conductive metal plate. The female terminal fitting 10 has a front end for connection with a mating male terminal fitting and a rear end opposite the front end. A barrel 12 is formed at the rear end of the female terminal fitting 10 and is configured for connection with an end of a wire 11. A tube 13 is formed at the front end and is continuous with the barrel 12. The terms top and bottom are used herein to provide a convenient frame of reference, but are not intended to imply a required gravitational orientation. In this context, reference is made to FIGS. 5 and 6 concerning the vertical direction.

The barrel 12 includes an insulation barrel 12A to be crimped, bent or folded into connection with an insulation coating of the wire 11 and a wire barrel 12B forward of the insulation barrel 12A and configured to be crimped, bent or folded into connection with a conductive core of the wire 11.

Figure 6:
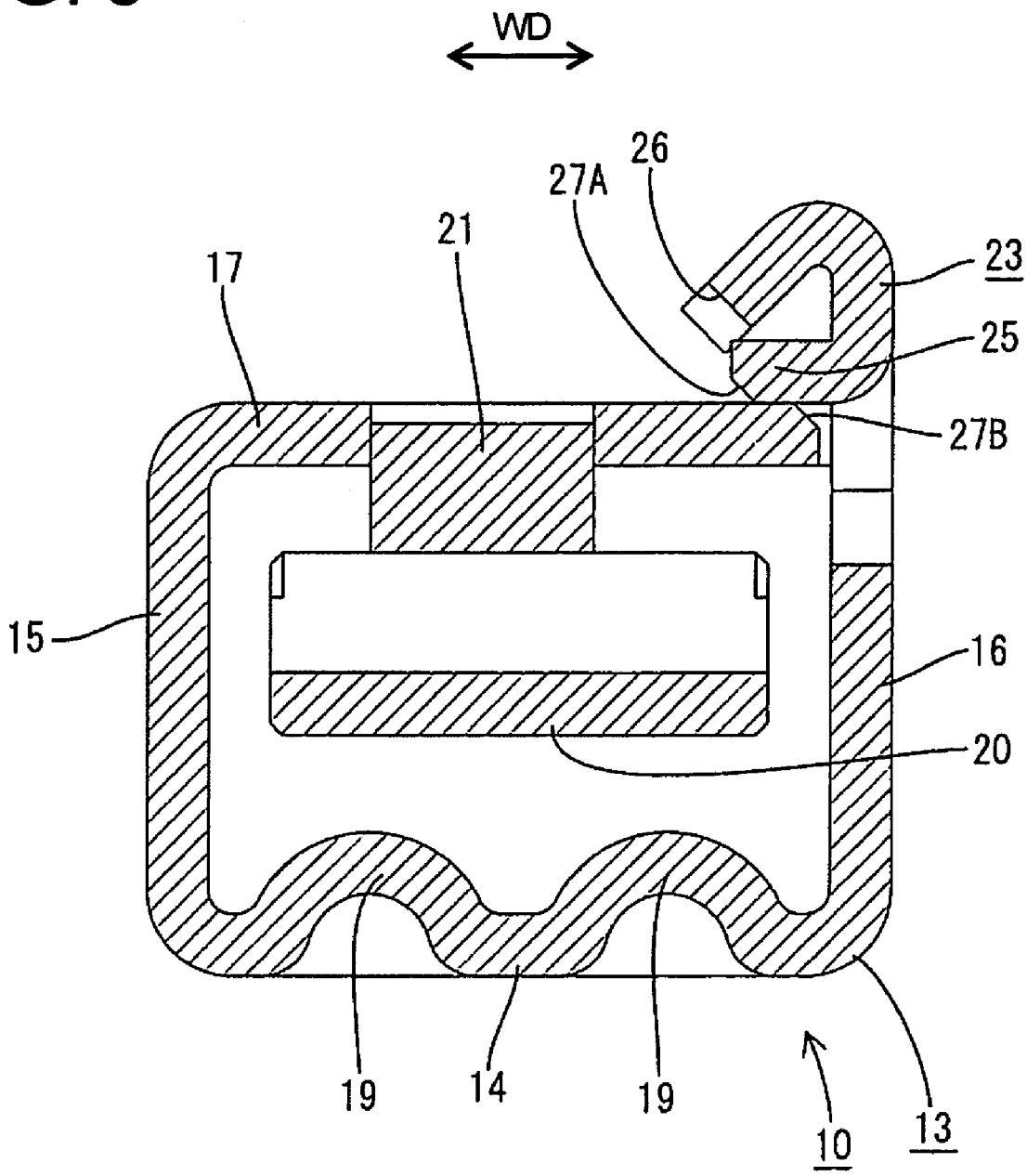
FIG. 6 is a section along 6-6 of FIG. 1.

The tube 13 is a narrow rectangle that is long in forward and backward directions FBD. Additionally, the tube 13 has a partly open front end so that an unillustrated mating male terminal fitting can be inserted into the tube 13 from the front. As shown in FIG. 6, the rectangular tube 13 has a narrow bottom plate 14 that is long in forward and backward directions FBD. A first side plate 15 projects up from the left edge of the bottom plate 14 in FIG. 6 and a second side plate projects up from the right edge of the bottom plate 14. An upper plate 17 is bent from an upper end portion of the first side plate 15 towards the second side plate 16 and extends substantially parallel to the bottom plate 14. Even though the invention is described with reference to a substantially rectangular tube, it should be understood that the invention also is applicable to tubes having other shapes, such as substantially quadratic or polygonal shapes having five or more sides.

A locking hole 18 is formed close to a rear end of the bottom plate 14. An unillustrated lock of a connector housing can engage the locking hole 18 to hold the female terminal fitting 10 in the housing. In other embodiments, a locking recess or projection can be provided instead of the locking hole 18 for engagement by the lock of the housing. Bulges 19 are formed on the bottom plate 14 and project into the tube 13 near the front end of the bottom plate 14. The bulges 19 extend in forward and backward directions FBD and are disposed substantially side by side along the width direction WD of the bottom plate 14, as shown in FIGS. 5 and 6.

Figure 2:
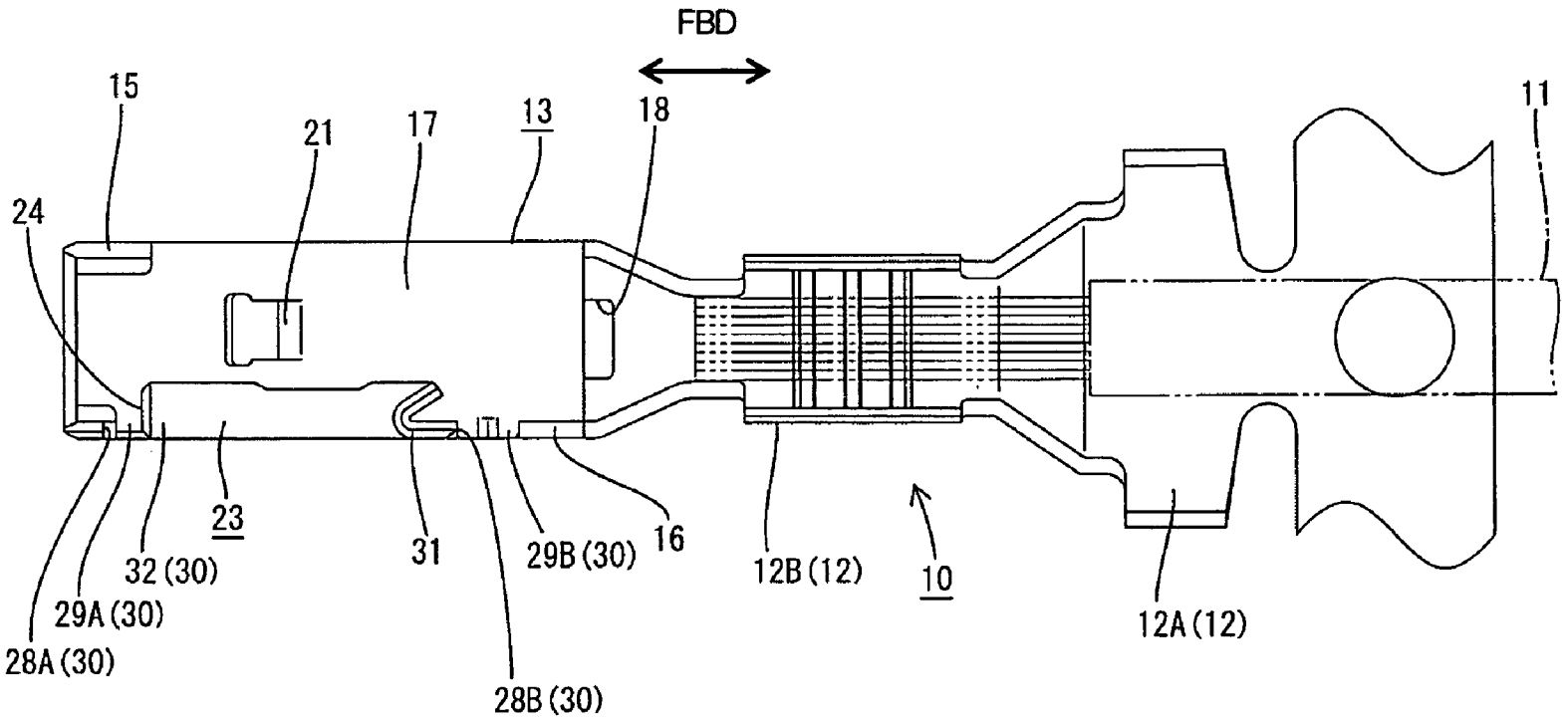
FIG. 2 is a plan view of the female terminal fitting.
Figure 3:
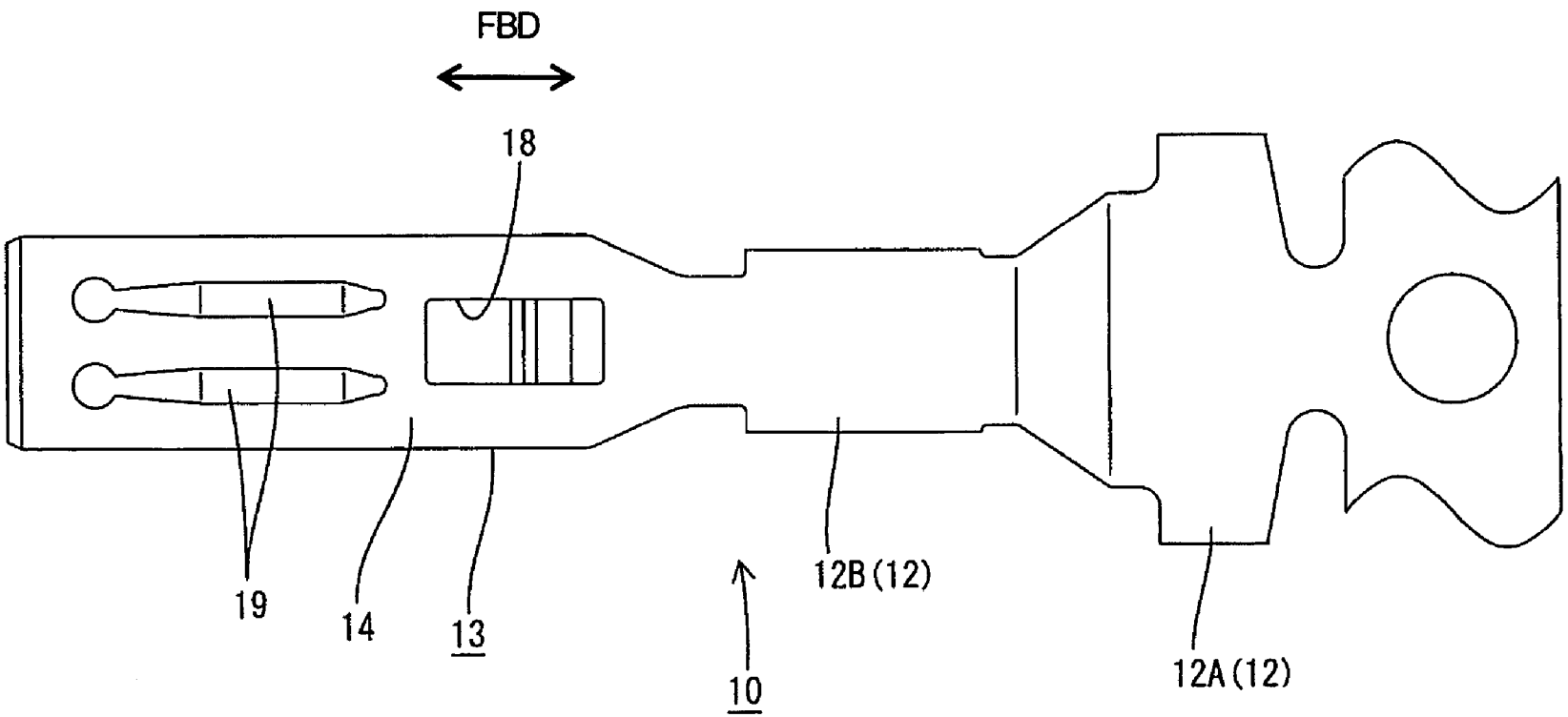
FIG. 3 is a bottom view of the female terminal fitting.
Figure 4:
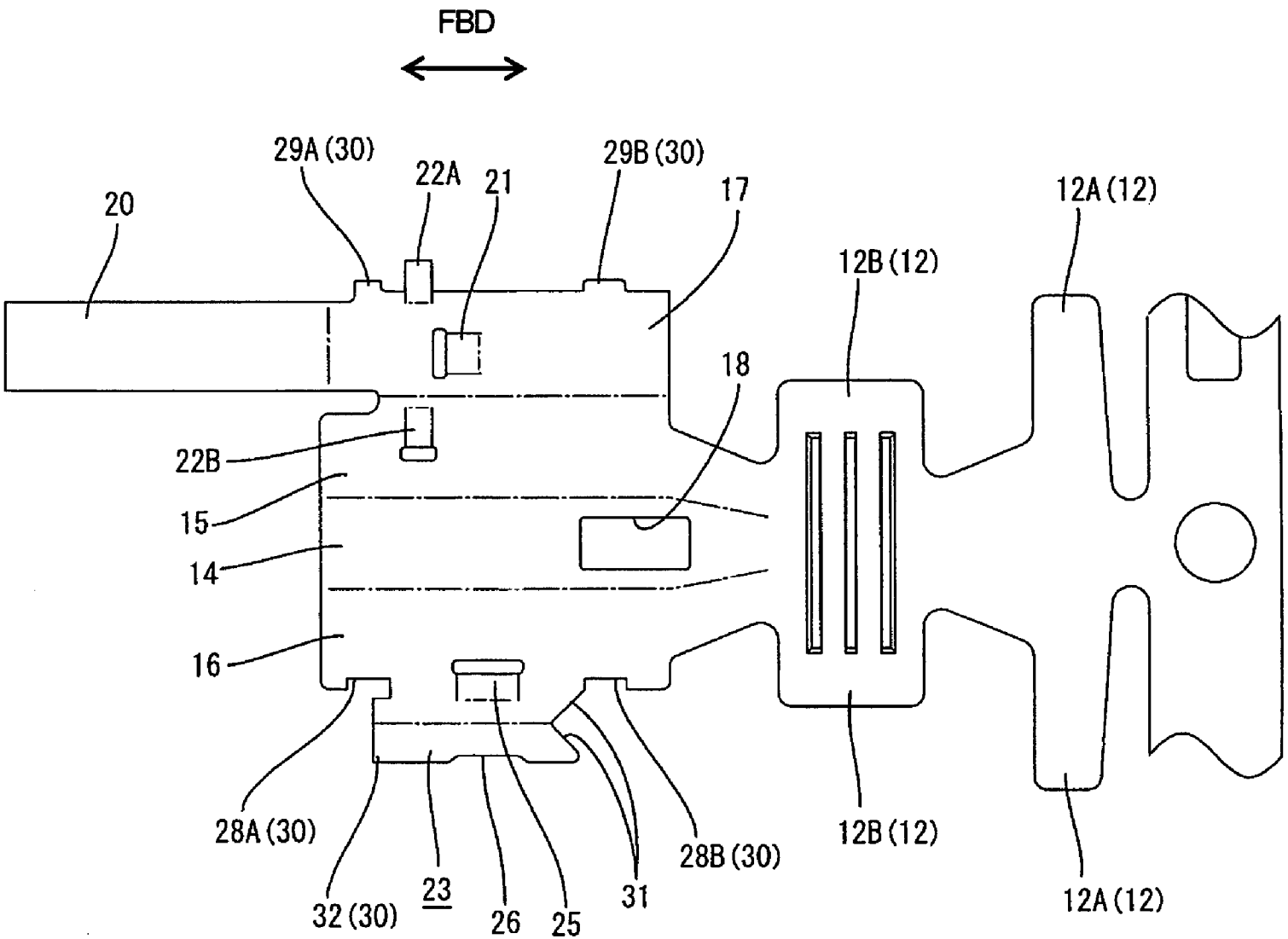
FIG. 4 is a development of the female terminal fitting.
Figure 5:
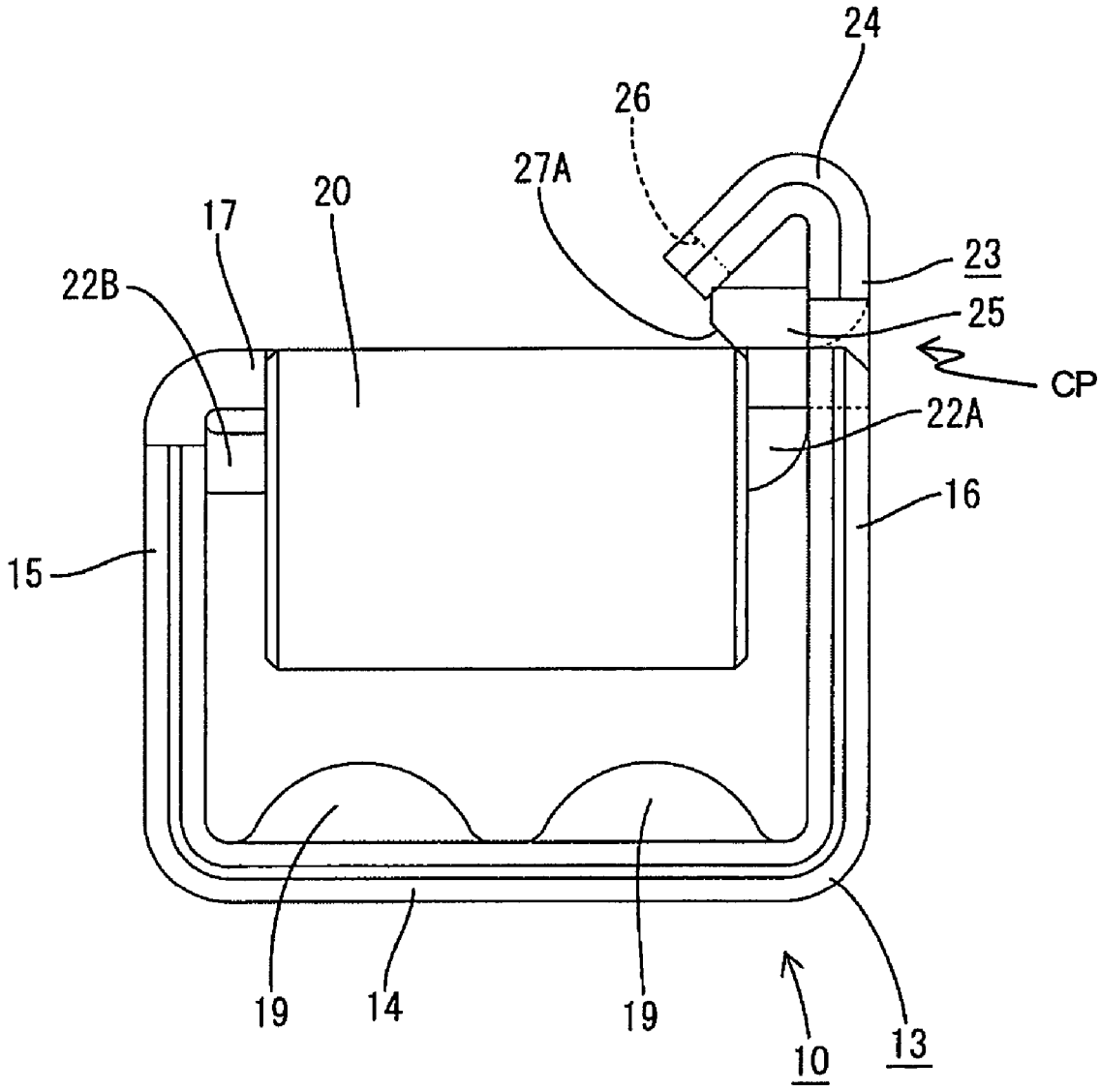
FIG. 5 is a front view of the female terminal fitting.

A resilient contact 20 extends forward from the front edge of the upper plate 17 and then is folded back into the tube 13, as shown in FIGS. 4 and 5. Although not shown in detail, the resilient contact 20 is bent to have a peak in the tube 13 and is resiliently deformable towards the upper plate as the mating terminal fitting is inserted into the tube 13. Thus, the male terminal fitting can be engaged tightly between the peak of the bend in the resilient contact 20 and the bulges 19 in the bottom plate 14 to achieve a high quality electrical connection. An excessive deformation preventing piece 21 is formed by making a substantially rectangular cut in a center part of the upper plate 17 with respect forward and backward directions FBD and then bending the cut part of the upper plate 17 into the tube 13, as shown in FIG. 2. The excessive deformation preventing piece 21 prevents the resilient contact 20 from deforming excessively resilient when contacted by the male terminal fitting.

As shown in FIG. 4, a substantially rectangular auxiliary resilient piece 22A projects up and out from the upper edge (in FIG. 4) of a front part of the upper plate 17. The auxiliary resilient piece 22A then is folded back and in towards the tube 13, as shown in FIG. 5. On the other hand, a substantially rectangular auxiliary resilient piece 22B is formed near a front part of the first side plate 15 by cutting the side plate 15 and bending the cut part into the tube 13, as shown in FIGS. 4 and 5. The auxiliary resilient pieces 22A, 22B are above and outward of the resilient contact 20 and are engageable with the outer surface of the resilient contact 20 from above and outside. Additionally, the auxiliary resilient pieces 22A, 22B are resiliently deformable up and down in the tube 13 along a direction intersecting an insertion direction of the mating terminal fitting into the tube 13. Thus, a male terminal fitting inserted into the rectangular tube 13 contacts and resiliently deforms the resilient contact 20. Additionally, the outer surface of the resilient contact 20 contacts at least one of the auxiliary resilient pieces 22A, 22B from below and inside. As a result the rigidity of the resilient contact 20 is improved by resilient forces of the auxiliary resilient pieces 22A, 22B.

Figure 1:
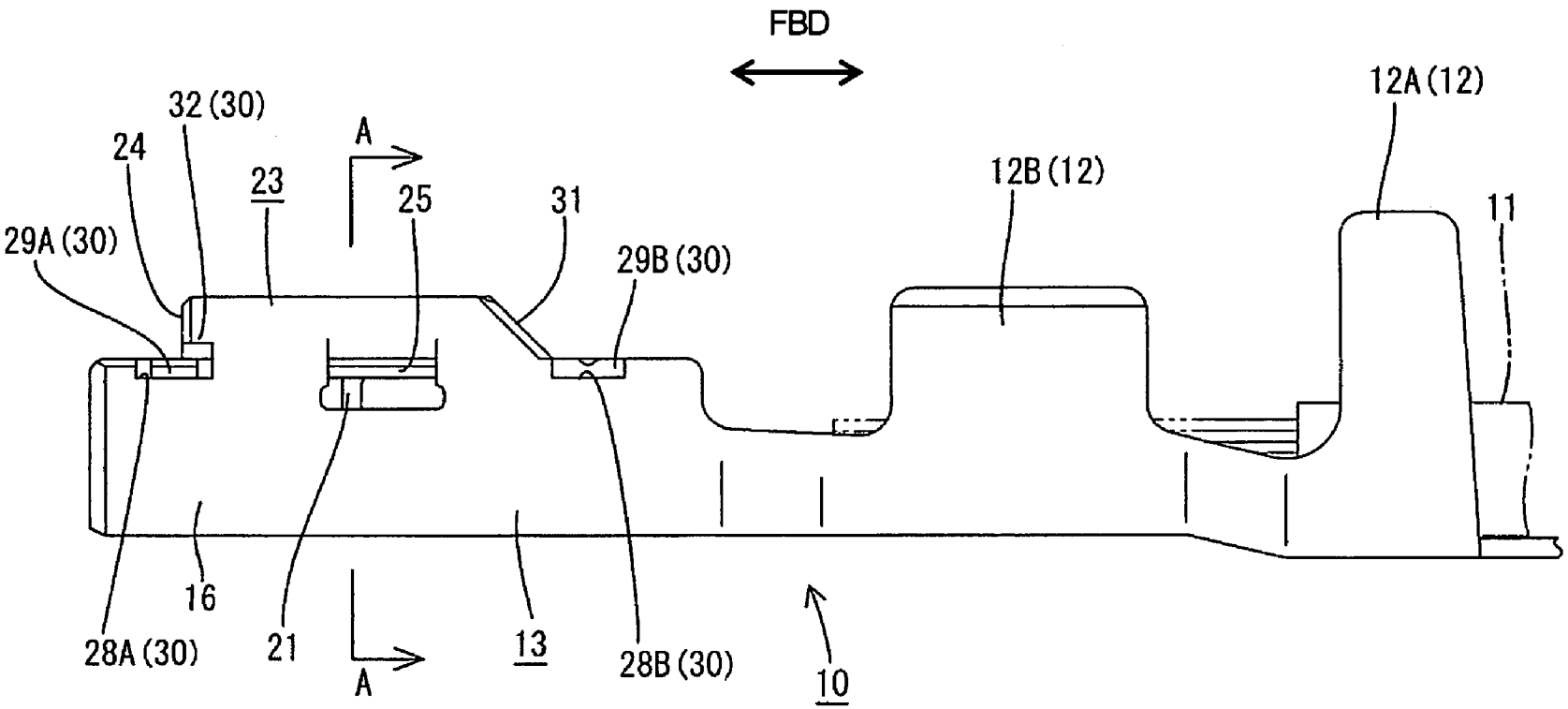
FIG. 1 is a right side view of a female terminal fitting according to a first embodiment.

A standing portion 23 stands up from the second side plate 16 and out beyond a connected portion CP of the second side plate 16 and the upper plate 17, as shown in FIG. 6. The upper end of the standing portion 23 is bent laterally in and a detecting surface 24 is defined at bent area of the front end of the standing portion 23. A probe (not shown) can be inserted into the connector housing from the front and into contact with the detecting surface 24 for testing an electrical connection of the female terminal fitting 10 with the male terminal fitting. As shown in FIG. 1, the standing portion 23 is substantially at the longitudinal center of the second side plate 16.

Figure 7:
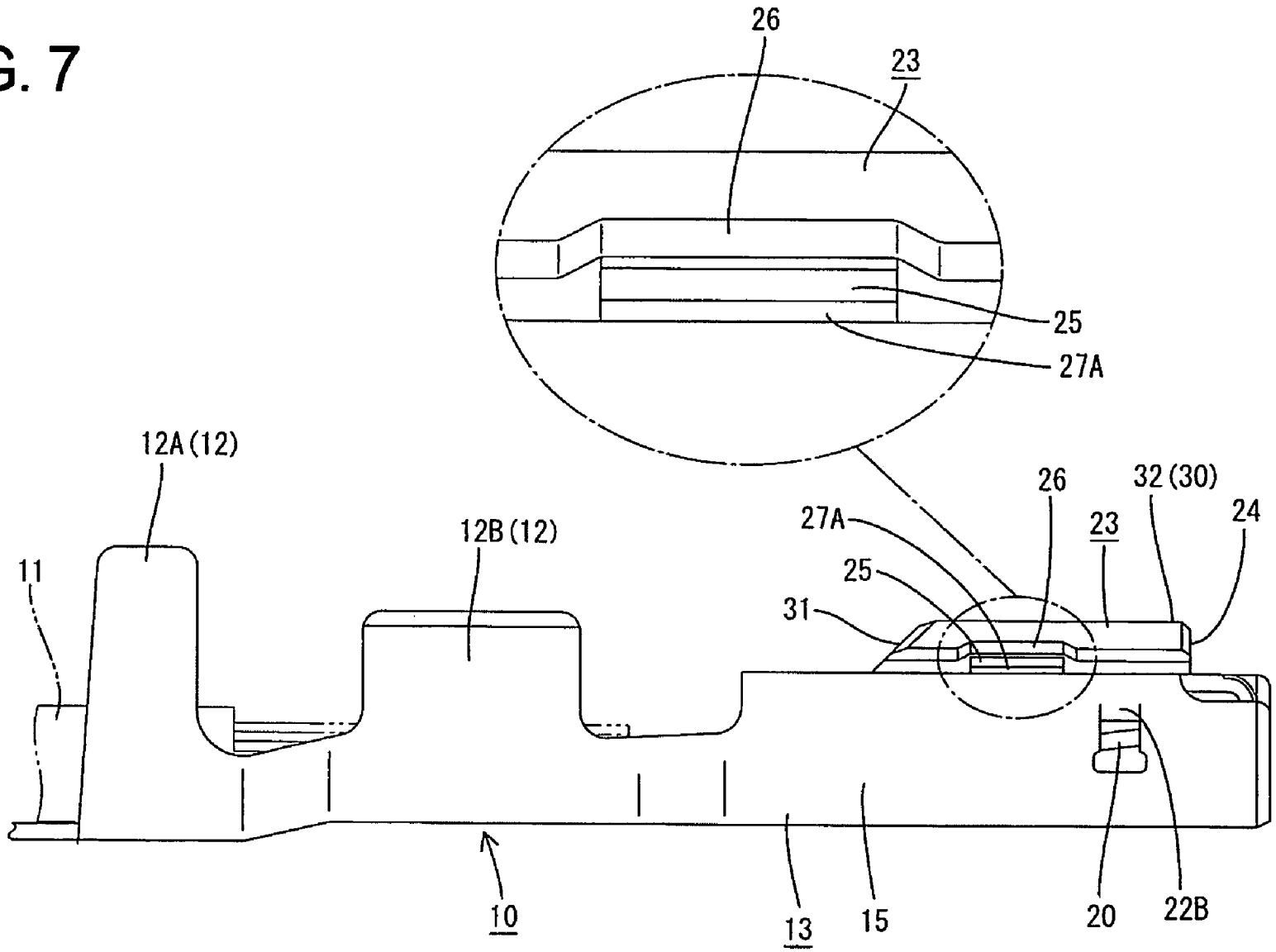
FIG. 7 is a left side view of the female terminal fitting.

As shown in FIG. 1, a substantially V- or U-shaped slit is formed over the standing portion 23 and the second side plate 16 at an intermediate part of the standing portion 23 with respect to forward and backward directions FBD. A substantially rectangular pressing portion 25 is enclosed in the slit and has a free bottom end that is bent inwardly at an angle of substantially at 90° at an intermediate height position of the standing portion 23. The bent portion is placed on the outer surface of the upper plate 17. As shown in FIGS. 6 and 7, the leading edge of the standing portion 23 is recessed slightly up and out to form an escaping recess 26 for preventing interference with the pressing portion 25.

A chamfer 27A is formed at the leading end of the pressing portion 25 near the upper plate 17. Additionally, a chamfer 27B is formed at the leading end of the upper plate 17 that contacts the pressing portion 25. The chamfers 27A, 27B avoid mutual interference of the pressing portion 25 and the upper plate 17 upon assembling the rectangular tube portion 13.

As shown in FIGS. 1 and 2, substantially U-shaped downwardly extending recesses 28A, 28B are formed at the upper edge of the second side plate 16 before and behind the standing portion 23. On the other hand, projections 29A, 29B project out at the leading edge of the upper plate 17 at positions corresponding to the recesses 28A, 28B, as shown in FIGS. 2 and 4. The projections 29A, 29B contact the bottom walls of the recesses 28A, 28B from above to prevent the upper plate 17 from collapsing inwardly. As shown in FIG. 2, leading edges of the projections 29A, 29B are substantially flush with the outer side surface of the second side plate 16. A front end edge 32 of the standing portion 23 is above the front projection 29A to prevent the upper plate 17 from bending outwardly. The rear projection 29B is driven from above, and is crimped, bent or folded into connection with the side walls of the rear recess 28B to prevent the upper plate 17 from lifting. Thus, a front lift preventing means 30 is formed by the front recess 28A, the front projection 29A and the front end edge 32 of the standing portion 23, and a rear lift preventing means 30 is formed by the rear recess 28B and the rear projection 29B.

An escaping surface 31 is formed at the rear edge of the standing portion 23 and inclines down toward the back to let a driving jig (not shown) escape while driving the rear projection 29.

The rectangular tube 13 is formed from an electrically conductive metal plate that is punched or cut into the shape shown in FIG. 4. Subsequently, the bottom plate 14 is embossed or cut and bent to cause the bulges 19 to bulge out on the top surface of the metal plate. Thereafter, the respective parts are bent along fold lines shown by chain lines in FIG. 4.

The auxiliary resilient pieces 22A, 22B are bent towards the top to face the upper plate 17. Subsequently, the excessive deformation preventing piece 21 is bent toward the top substantially at a right angle. The resilient contact piece 20 then is folded back at the front end of the upper plate 17 and is bent into a substantially mountain shape.

The pressing portion 25 then is bent substantially at right angle towards the top side and the standing portion 23 is folded back towards the top.

The upper plate 17 is bent substantially at a right angle towards the top, and the first side plate 15 is bent in substantially at a right angle so that the upper plate 17 and the bottom plate 14 substantially face each other. The second side plate 16 then is bent in substantially at right angle. At this time, the projections 29A, 29B on the upper plate 17 are fit into the respective recesses 28A, 28B in the second side plate 16, and the pressing portion 25 is placed on the outer surface of the upper plate 17. The chamfers 27A, 27B prevent interference between the upper plate 17 and the pressing portion 25.

The rear projection 29B then is driven from above by the unillustrated jig and is crimped, bent or folded into connection with the side walls of the rear recess 28B to prevent the upper plate 17 from lifting. Interference of can be prevented since The escaping surface 31 is formed at the rear end of the standing portion 23 to prevent interference between the jig and the standing portion 23. The driving of the projection 29B has the potential to distort the rectangular tube 13. However, the front projection 29A of the rectangular tube 13, which is required to have a high dimensional precision due to secure an electrical connection between the male terminal fitting and the resilient contact 20, is not deformed. Rather, the rear projection 29B, which is not required to have a high dimensional precision as compared to the front side of the rectangular tube portion 13, is driven or deformed.

The pressing portion 25 can resiliently engage the outer surface of the upper plate 17 to prevent an opening movement of the bent upper plate 17. The rectangular tube 13 could twist to displace the upper plate 17 and the second side plate 16 along forward and backward directions FBD. However, the pressing portion 25 can be placed on the outer surface of the upper plate 17 without correcting the posture of the upper plate 17 for displacement in forward and backward directions FBD. The upper plate 17 and the second side plate 16 could be displaced vertically with respect to each other. However, the rectangular tube 13 is formed by correcting the posture of the upper plate 17 through a vertical resilient deformation of the upper plate 17 and by placing the pressing portion 25 on the outer surface of the upper plate 17. Thus, the rectangular tube 13 can be formed easily by correcting the posture of the upper plate 17 vertically even if the resilient contact 20 is twisted.

The pressing portion 25 is formed at the standing portion 23 that projects from the second side plate 16. Additionally, the lift preventing portions 30 are provided before and behind the standing portion 23 to prevent the upper plate 17 from lifting in areas where the standing portion 23 is not formed.

The lift preventing portion 30 behind the standing portion 23 prevents the upper plate 17 from lifting. More particularly, the substantially V- or U-shaped recess 28B is provided at the upper edge of the second side plate 16 and the projection 29 of the upper plate 17 fits into the recess 28B. The projection 29B is driven, crimped, bent or folded to fit into the recess 28B and engages the side walls of the recess 28B. Since the upper plate 17 cannot lift, it is unnecessary to locate the front end edge 32 of the standing portion 23 above the upper plate 17. As a result, there is no need for a member above the upper plate 17 to prevent the upper plate 17 from lifting. Thus, metal is used more efficiently to make a yield of the female terminal fitting 10.

The pressing portion 25 is bent in at an intermediate height of the standing portion 23 and therefore is within a projecting range of the standing portion 23. Thus, projecting distances of the standing portion 23 and the pressing portion 25 in the developed state of the female terminal fitting 10 are reduced as compared, for example, to a case where an extending portion extends up from the side plate and is folded back into contact with the upper plate 17. Therefore, a yield of the female terminal fittings 10 can be improved.

Further, the detecting surface 24 is formed in the bent area of the front end surface of the standing portion 23. Thus, the probe for an electrical connection test can easily contact the detecting surface 24 from the front. In this way, the precision of the electrical connection test between the female terminal fitting 10 and the male terminal fitting is improved.

Figure 8:
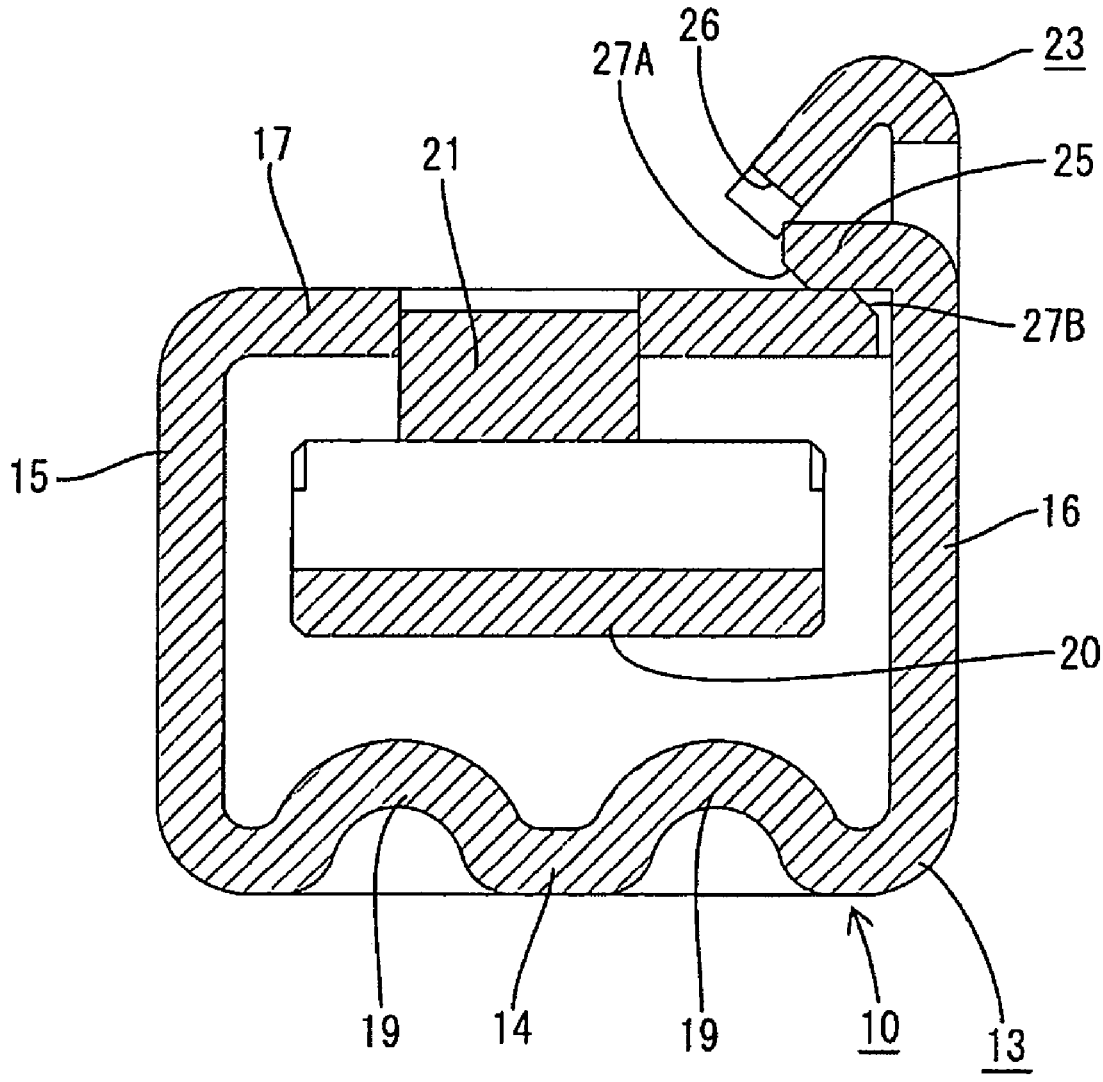
FIG. 8 is a section similar to FIG. 6, but showing a second embodiment.

A second embodiment is described with reference to FIG. 8. A substantially V- or U-shaped slit is formed along the standing portion 23 and the second side plate 16 at an intermediate part of the standing portion 23 with respect to forward and backward directions FBD. The slit forms a substantially rectangular pressing portion 25 with a free upper end. The pressing portion 25 is bent in at substantially 90° at an intermediate height position of the standing portion 23 and the bent portion is placed on the outer surface of the upper plate 17. The other construction is similar or substantially the same as in the first embodiment. Thus no repetitive description is given, and the similar or identical parts merely are identified by the same reference numerals.

According to this embodiment, the second side plate 16 has no opening communicating with the inside of the rectangular tube 13. Thus, external matter cannot enter into the rectangular tube 13.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The invention is applied to a female terminal fitting in the foregoing embodiments. However, the invention also can be applied to male terminal that has a tube 13.

The end edge of the standing portion 23 is above the projection 29A formed on the upper plate 17 only in the lift preventing portion 30 located before the standing portion 23 in the foregoing embodiments. However, the lift preventing portion 30 located behind the standing portion 23 may be constructed similarly. In such a case, the lift preventing portion 30 behind the standing portion 23 may not be driven.

In the foregoing embodiments, only the projection 29B formed on the upper plate 17 behind the standing portion 23 is fit into the recess 28B in the side plate and driven to crimp the end of the projection 29B into connection with the side walls of the recess 28B. However, the invention is not limited thereto, and the lift preventing portion 30 before the standing portion 23 may also be driven or deformed, for example, if no dimensional precision is required for the front side of the rectangular tube 13. In such a case, the standing portion 23 above the lift preventing portion 30 can be omitted.

The detecting surface 24 is formed by bending the upper-end of the standing portion 23 inwardly in the foregoing embodiments. However, the upper-end of the standing portion 23 need not be bent, for example, if a detecting portion is provided separately from the standing portion 23.

The lift preventing portions 30 are before and behind the standing portion 23 in the foregoing embodiments. However, the lift preventing portion 30 may be only before or behind the standing portion 23. Further, the lift preventing portions 30 can be omitted if the pressing portion 25 can prevent lift of the upper plate 17.

What is claimed is:

1. A terminal fitting, comprising:

a tube with a bottom plate, first and second side plates bent from opposite sides of the bottom plate, a ceiling plate bent from a part of the first side plate spaced from the bottom plate and extending into connection with a connected portion of the second side plate, the ceiling plate having an outer surface;

at least one standing portion extending unitarily from the second side plate and standing more outward than the connected portion of the second side plate with the ceiling plate, the standing portion and the second side plate lying substantially in a common plane; and at least one pressing portion cut from an intermediate area of the second side plate and bent unitarily up and in from the standing portion for contacting the outer surface of the ceiling plate, the pressing portion extending substantially perpendicularly from the plane in which the standing portion and the second side plate lie.

2. The terminal fitting of claim 1, further comprising a detecting portion bent in from a distal end of the standing portion and disposed for contact by a probe for testing electrical connection of the terminal fitting.

3. The terminal fitting of claim 1, wherein at least one lift preventing portion is provided at least at a front part or at a rear part of the standing portion for preventing a lift of the ceiling plate.

4. A terminal fitting comprising:

a tube with first and second side plates, a ceiling plate bent from the first side plate into connection with a connected portion of the second side plate, the ceiling plate having an outer surface;

at least one standing portion standing more outward than the connected portion of the second side plate with the ceiling plate;

at least one pressing portion cut from an intermediate area on at least one of the second side plate and the standing portion, the pressing portion being bent up and towards the first side plate and contacting the outer surface of the ceiling plate; and at least one lift preventing portion provided at least at a front part or at a rear part of the standing portion for preventing a lift of the ceiling plate, wherein the lift preventing portion is formed with at least one recess at an edge of the second side plate, at least one projecting piece at an end edge of the ceiling plate, the projecting piece being deformed and driven into connection with side walls of the recess.

5. A terminal fitting comprising:

a tube with first and second side plates, a ceiling plate bent from the first side plate into connection with a connected portion of the second side plate, the ceiling plate having an outer surface;

at least one standing portion standing more outward than the connected portion of the second side plate with the ceiling plate; and at least one pressing portion cut and bent from the standing portion and contacting the outer surface of the ceiling plate, an escaping recess being formed at a leading edge of the standing portion for preventing interference with the pressing portion.

6. The terminal fitting of claim 4, further comprising a chamfered surface at a lateral edge of a leading end of the pressing portion near the ceiling plate for avoiding interference with the ceiling plate upon assembling the tube.

7. The terminal fitting of claim 4, further comprising a chamfered surface at a lateral edge of a leading end of the ceiling plate to be held in contact with the pressing portion for avoiding interference with the pressing portion upon assembling the tube.

8. The terminal fitting of claim 4, further comprising a chamfered surface at a lateral edge of a leading end of the pressing portion near the ceiling plate and a chamfered surface at a lateral edge of a leading end of the ceiling plate to be held in contact with the pressing portion for avoiding mutual interference between the pressing portion and the ceiling plate upon assembling the tube.

9. The terminal fitting of claim 1, further comprising a resilient contact in the tube for contacting a mating terminal fitting, and at least one auxiliary resilient piece disposed on the tube portion for contacting the resilient contact when the resilient contact is deformed by the mating terminal fitting, whereby the auxiliary resilient piece improves rigidity of the resilient contact.

10. The terminal fitting of claim 1, further comprising a bend between the pressing portion and the standing portion, the bend having a convex surface, the pressing portion having a pressing surface contacting the outer surface of the ceiling plate, the pressing surface extending continuously from the convex surface of the bend.

11. The terminal fitting of claim 10, wherein the bend lies substantially in plane defined by the second side plate.

12. The terminal fitting of claim 1, wherein the terminal fitting is formed from a unitarily piece of metal having opposite first and second surfaces, the first surface including the outer surface of the ceiling plate and a surface of the pressing portion that contacts the outer surface of the ceiling plate.

* * * * *